US009056655B1

(12) United States Patent
Durar et al.

(10) Patent No.: US 9,056,655 B1
(45) Date of Patent: Jun. 16, 2015

(54) ESCORT VESSEL STAPLE TORQUE ALIGNING WINCH SYSTEM

(71) Applicants: Brandon Durar, Manahawkin, NJ (US); Gregory Castleman, Kemah, TX (US)

(72) Inventors: Brandon Durar, Manahawkin, NJ (US); Gregory Castleman, Kemah, TX (US)

( * ) Notice: Subject to any disclaimer, the term of this patent is extended or adjusted under 35 U.S.C. 154(b) by 0 days.

(21) Appl. No.: 14/093,910

(22) Filed: Dec. 2, 2013

(51) Int. Cl.

| | |
|---|---|
| ***B63B 21/04*** | (2006.01) |
| ***B63B 21/16*** | (2006.01) |
| ***B63B 21/56*** | (2006.01) |

(52) U.S. Cl.
CPC ..... *B63B 21/16* (2013.01); *B63B 21/56* (2013.01)

(58) Field of Classification Search
USPC ..... 114/253, 254
IPC ..... B63B 35/816,21/16
See application file for complete search history.

(56) References Cited

U.S. PATENT DOCUMENTS

| | | | | |
|---|---|---|---|---|
| 5,213,222 | A | 5/1993 | Becker | |
| 5,609,120 | A | 3/1997 | Eronen | |
| 6,698,374 | B1 | 3/2004 | Van Der Laan | |
| 2009/0266285 | A1 * | 10/2009 | Durar et al. ..... | 114/253 |

* cited by examiner

*Primary Examiner* — Stephen Avila
(74) *Attorney, Agent, or Firm* — Michael I. Kroll

(57) ABSTRACT

The present invention discloses an escort vessel towline force responsive apparatus comprising a rotative winch system mounted to the deck of an escort vessel so that when the tow line between a distressed vessel and the winch system of an escort vessel angularly changes, the escort vessel winch system will automatically rotate until the line of force is substantially in linear alignment with the center line of the escort vessel winch system.

6 Claims, 13 Drawing Sheets

MAXIMUM STEERING FORCES - CONVENTIONAL STAPLE

| 40 Speed knots | 42 Maximum Steering Force tonnes | 44 Associated Braking Force tonnes | 46 Tug Angle to Flow degrees | 48 Towline Angle to Ship degrees | 50 Towline Angle to Tug degrees | 52 Heel Angle degrees | 54 Residual Freeboard m |
|---|---|---|---|---|---|---|---|
| 8 | 81 | -9 | -143 | 84 | -59 | 9.4 | 0.01 |
| 10 | 76 | 0 | -159 | 90 | -69 | 9.3 | 0.05 |

FIG. 5

MAXIMUM STEERING FORCES - AUTO POSITION WINCH

| 40 | 42 | 44 | 46 | 48 | 50 | 52 | 54 |
|---|---|---|---|---|---|---|---|
| Speed | Maximum Steering Force | Associated Braking Force | Tug Angle to Flow | Towline Angle to Ship | Towline Angle to Tug | Heel Angle | Residual Freeboard |
| knots | tonnes | tonnes | degrees | degrees | degrees | degrees | m |
| 8 | 89 | -14 | -141 | 81 | -60 | 9.1 | 0.02 |
| 10 | 87 | -3 | -157 | 88 | -69 | 9.3 | 0.01 |

FIG. 6

MAXIMUM BRAKING FORCES - CONVENTIONAL STAPLE

| 40 Speed knots | 42 Maximum Steering Force tonnes | 44 Associated Braking Force tonnes | 46 Tug Angle to Flow degrees | 48 Towline Angle to Ship degrees | 50 Towline Angle to Tug degrees | 52 Heel Angle degrees | 54 Residual Freeboard m |
|---|---|---|---|---|---|---|---|
| 8 | 101 | 0 | 180 | 0 | 180 | 0.0 | 1.68 |
| 10 | 105 | 0 | 180 | 0 | 180 | 0.0 | 1.68 |

FIG. 7

MAXIMUM BRAKING FORCES - AUTO POSITION WINCH

| 40 | 42 | 44 | 46 | 48 | 50 | 52 | 54 |
|---|---|---|---|---|---|---|---|
| Speed | Maximum Steering Force | Associated Braking Force | Tug Angle to Flow | Towline Angle to Ship | Towline Angle to Tug | Heel Angle | Residual Freeboard |
| knots | tonnes | tonnes | degrees | degrees | degrees | degrees | m |
| 8 | 101 | 0 | 180 | 0 | 180 | 0.0 | 1.68 |
| 10 | 116 | 39 | -158 | 19 | -140 | 9.3 | 0.05 |

FIG. 8

ESCORT VESSEL STAPLE TORQUE ALIGNING WINCH SYSTEM

BACKGROUND OF THE INVENTION

1. Field of the Invention

The present invention relates generally to winch systems and, more specifically, to a staple-torque rotative winch mounted to the deck of an escort vessel so that when an escort vessel tow line extends from the winch drum through a staple or bullnose to an escorted vessel, the staple serves as towline guideway so that lateral tow line torque forces impinged on the staple rotates the winch so that the towline is substantially in linear alignment with the center line of the escort vessel winch system and the escorted vessel tow anchor point.

2. Description of the Prior Art

There are other winch systems designed for escort tugs. While these systems may be suitable for the purposes for which they where designed, they would not be as suitable for the purposes of the present invention as heretofore described.

It is thus desirable to provide an escort tug with a deck mounted rotative winch so that when the winch rotates towards the line of force the heel angle of the tug decreases.

SUMMARY OF THE PRESENT INVENTION

A primary object of the present invention is to provide an automatically rotative winch system for an escort vessel tow line.

Another object of the present invention is to provide an escort vessel winch system that reduces the side force on the winch.

Yet another object of the present invention is to provide an escort vessel with a winch system that is deck mounted on a slewing ring.

Still yet another object of the present invention is to provide an escort vessel with a rotative winch system that is capable of reducing the heeling angle of an escort vessel without reducing the line pull.

Another object of the present invention is to provide an escort vessel with a rotative winch system that is capable of increasing line pull as the heeling angle of the escort vessel increases.

Additional objects of the present invention will appear as the description proceeds.

The present invention overcomes the shortcomings of the prior art by providing an automatically rotative winch mounted to the deck of an escort vessel so that when the tow line force between a distressed vessel and the winch system of an escort vessel angularly changes, the escort vessel winch system will automatically rotate until the line of force is substantially in linear alignment with the center line of the escort vessel winch system.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which:

FIG. 5 is a chart showing maximum steering test data results for forward ship speeds of 8 and 10 knots for the escort tug using conventional staple.

FIG. 6 is a chart showing maximum steering test data results for forward ship speeds of 8 and 10 knots for the escort tug using the torque rotative winch of the present invention.

FIG. 7 is a chart showing maximum braking test data results for forward ship speeds of 8 and 10 knots for the escort tug using conventional staple.

FIG. 8 is a chart showing maximum braking test data results for forward ship speeds of 8 and 10 knots for the escort tug using the torque rotative winch of the present invention.

DESCRIPTION OF THE REFERENCED NUMERALS

Figure 1:
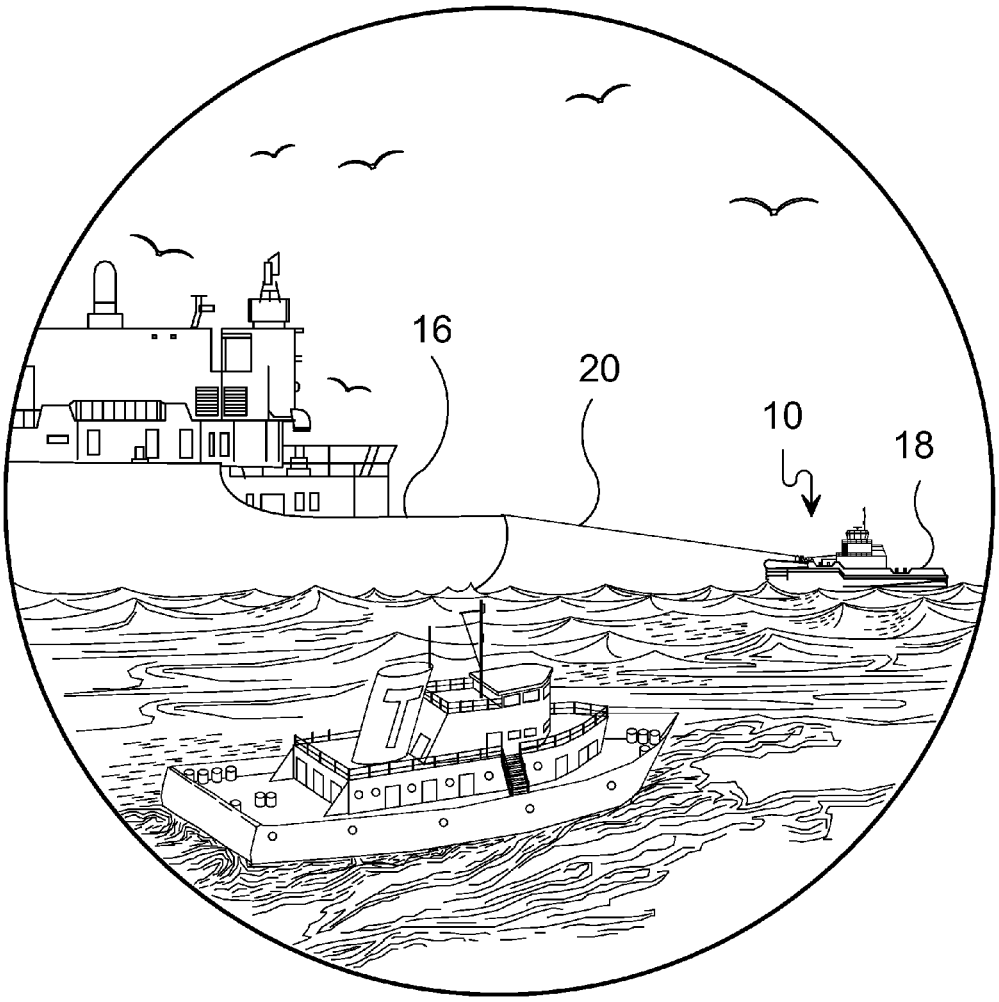
FIG. 1 is an illustrative view of the present invention in use.

Turning now descriptively to the drawings, in which similar reference characters denote similar elements throughout the several views, the Figures illustrate the method of constructing a catalog of the resources accessible through a network of the present invention. With regard to the reference numerals used, the following numbering is used throughout the various drawing figures.

10 force responsive towline apparatus of the Present Invention
12 winch
14 slewing ring
16 distressed vessel
18 escort vessel
20 line
22 propulsion force
24 center of pressure (COP)
26 beam
28 distance between propulsion unit and beam
30 distance between COP and beam
32 inner race
34 anti slip bearing
36 conventional staple
38 auto position winch
40 speed—knots
42 max. steering force
46 associated braking force
48 tug angle to flow
50 towline angle to ship

50 towline angle to tug
52 heel angle
54 residual freeboard

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an illustrative view of the present invention in use. The winch system 10 of the present invention was designed for the purpose of increasing the line pull (steering force) and safety of tugs 18 escorting ships 16 in protective waters using a simple mechanical advantage. An escort tug 18 is defined as a tug tethered 20 to the stern of a large ship or tanker 16. In an emergency, if a tanker or ship 16 has a loss of power or rudder failure the escort tug 18 will be ordered to go to the port or starboard side of the tanker (line or hawser 20 is attached to the ship or tanker) and will be directed by the pilot to go into the indirect mode or power indirect mode. The indirect mode is defined as an escort tug at 45 degrees to the tanker and at a jackknifed position with the z drives (thrusters) facing towards the ship the forces of dragging the tug through the water will control or turn the ship or tanker. The indirect mode can be used and is effective at higher speeds but is harder to get into position.

The present invention provides a winch system 10 that turns toward the line of force when said force is applied to the winch's integral staple whereby the heel angle will be reduced for the same line pull.

Figure 2:
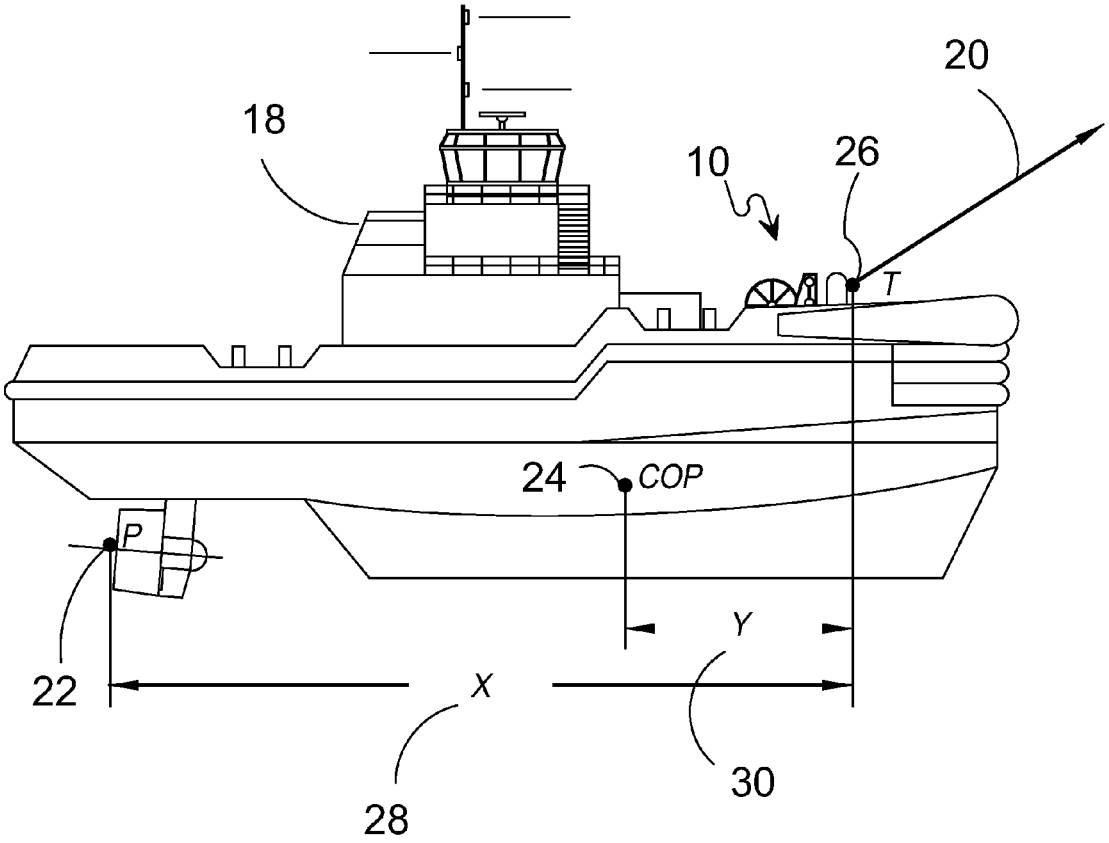
FIG. 2 is a side view of the present invention.

Referring to FIG. 2, shown is a side view of the present invention. As shown in the illustration, for the tug 18 to be in equilibrium the equation $P \times X = COP \times Y$ and $P + T = COP$ ("P" is "Z" drive force 22, "T" is tow line force 26 and "COP" is the tugs center of pressure 24 (the convergent point between the thruster forces and the winch towline force) must be achieved. If you isolate the terms $T = COP \times (1 - Y/X)$ is reduced the tow line 20 pull "T" will increase. As the winch of the present invention 10 rotates and "Y" becomes closer to the "COP" the ratio of "X" to "Y" 28, 30 is reduced and the line pull will increase with the same force at "P".

Figure 3:
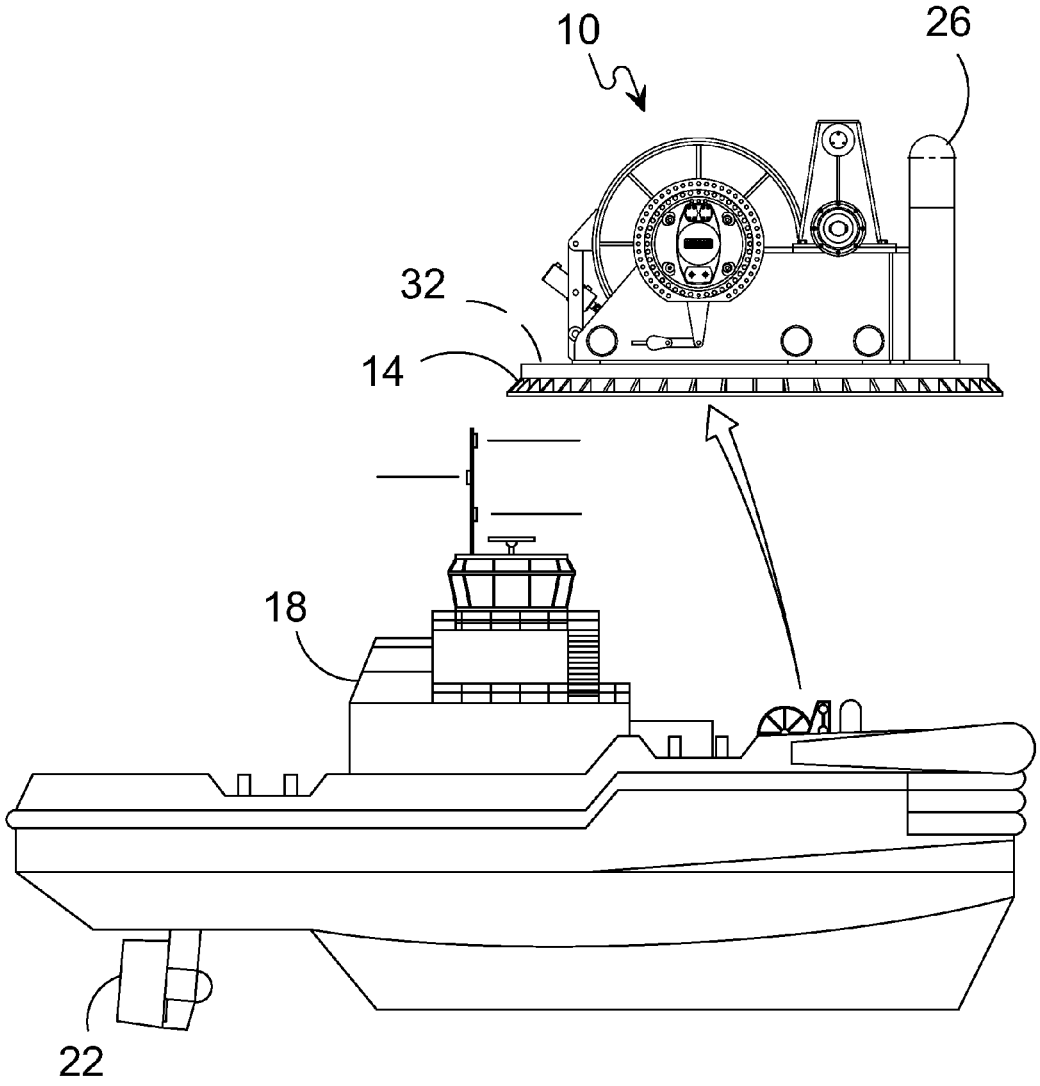
FIG. 3 is a side view of the present invention.

Referring to FIG. 3, shown is a side view of the present invention. The winch system of the present invention 10 and staple 26 (tow point) rotates 32 on a large slewing ring 14 and reduces the side loading on the escort vessel 18 winch also producing a level toe line wind.

Figure 4:
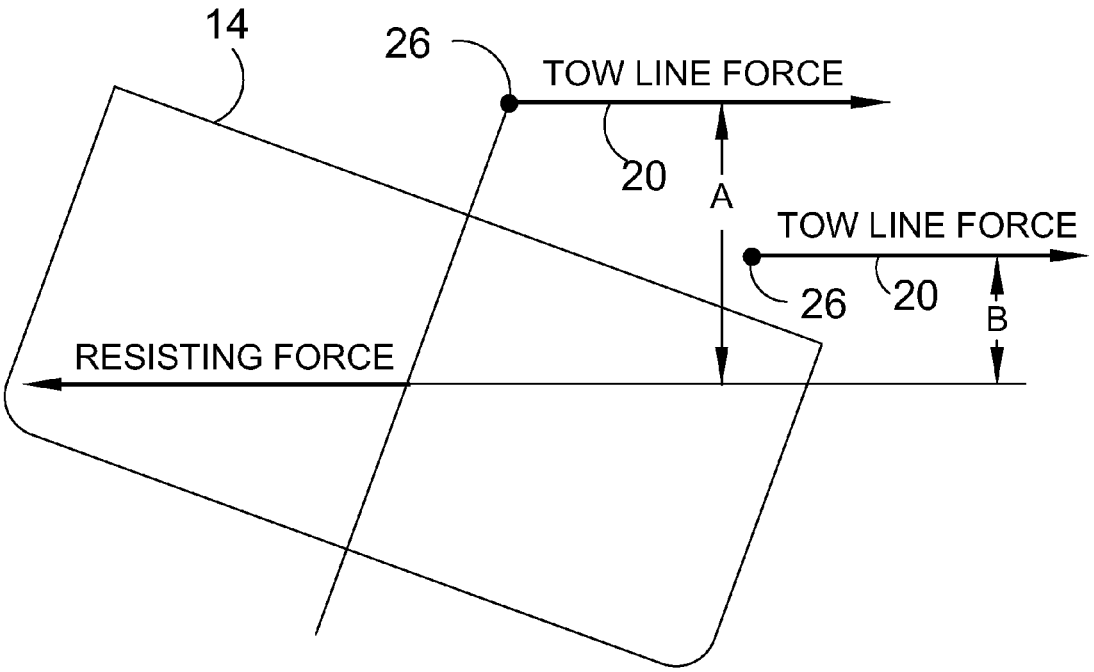
FIG. 4 is a view of method of the present invention.

Referring to FIG. 4, shown is a view of the method of the present invention. As the winch system of the escort vessel 14 turns 26 toward the line of force 20 the moment is decreased and the heel angle of the escort vessel 14 is reduced for the same line pull. The winch rotates at a right angle to the tug, the line pull will remain the same with less of a heeling angle or as the heeling angle is increased the line pull will also increase. Conceptual calculations indicate the winch system will increase tow line force by 25% and reduce a tug's heel angle by as much as 40%, which was born out by model testing using a 39 VSP tractor tug.

Referring to FIGS. 5 and 6, shown is escort tug maximum steering test data results for forward ship speeds of 8 and 10 knots for the escort tug using conventional staple and the auto position winch. The data shows the sign convention in which the forces and angles are presented.

Forward ship speed 40 of 8 knots using an escort tug with conventional staple showed a steering force 42 of 81 tonnes; associated braking force 44 of −9 tonnes; tug angle to flow 46 of −143°, towline angle to ship 48 of 84°; towline angle to tug 50 of −59°; heel angle 52 of 9.4 degrees and a residual freeboard 54 of 0.01 m. The data for the escort vessel equipped with the auto position winch (FIG. 6) produced a steering force 42 of 89 tonnes and braking force 44 of −14 tonnes. A 10% increase in steering force and increased braking force of >50%. Decreases in tug angle to flow 46, towline angles 48, 50, heel angle 52 and increase in residual freeboard 54 shows the increased capabilities of an escort tug having the auto position winch of the present invention. Also shown in FIGS. 5 and 6 are the test data results for a forward ship speed of 10 knots using an escort tug with conventional staple and the auto position winch again showing the increased capabilities of employing the auto position winch of the present invention.

Referring to FIGS. 7 and 8, shown is escort tug maximum braking test data results for forward ship speeds of 8 and 10 knots for the escort tug using conventional staple and the auto position winch. The data shows the sign convention in which the forces and angles are presented.

Forward ship speed 40 of 8 knots using an escort tug with conventional staple showed a steering force 42 of 101 tonnes; associated braking force 44 of 0 tonnes; tug angle to flow 46 of 180°; towline angle to ship 48 of 0°, towline angle to tug 50 of 180°: heel angle 52 of 0° and a residual freeboard 54 of 1.68 m. The data for the escort vessel equipped with the auto position winch (FIG. 8) produced a steering force of 101 tonnes and braking force of 0 tonnes; tug angle to flow 46 of 180°, towline angle to ship 48 of 0°, towline angle to tug 50 of 180°: heel angle 52 of 0° and a residual freeboard 54 of 1.68 m. Also shown in FIGS. 7 and 8 are the test data results for a forward ship speed of 10 knots using an escort tug with conventional staple and the auto position winch. Again showing the increased capabilities of employing the auto position winch of the present invention.

Figure 9:
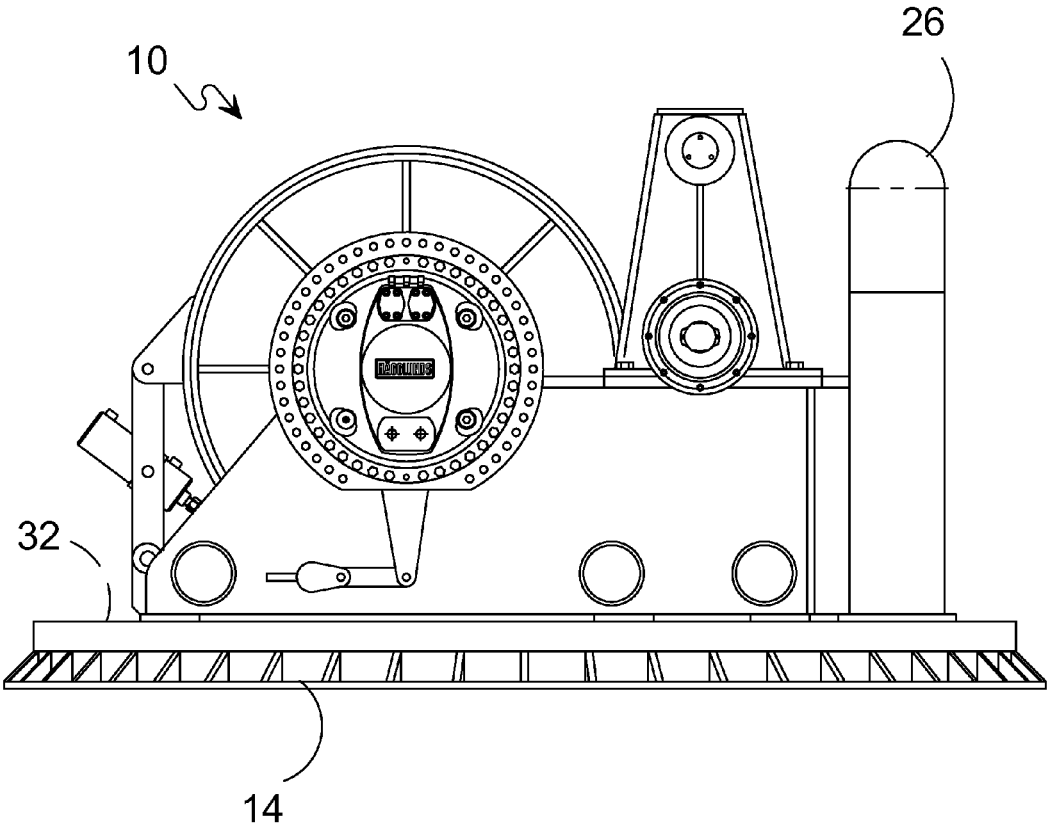
FIG. 9 is a side view of the winch of the present invention.

Referring to FIG. 9, shown is a side view of the winch of the present invention. The winch system 12 and staple 26 (tow point) of the present invention 10 rotates via 32 on a large slewing ring 14 and reduces the side loading on the winch and also produces a level wind. As the winch system of the present invention turns toward the line of force the movement is decreased and the heel angle reduced for the same line pull. The winch rotates at a right angle to the tug, the line pull will remain the same with less of a heeling angle or as the heeling angle is increased the line pull will also increase.

Figure 10:
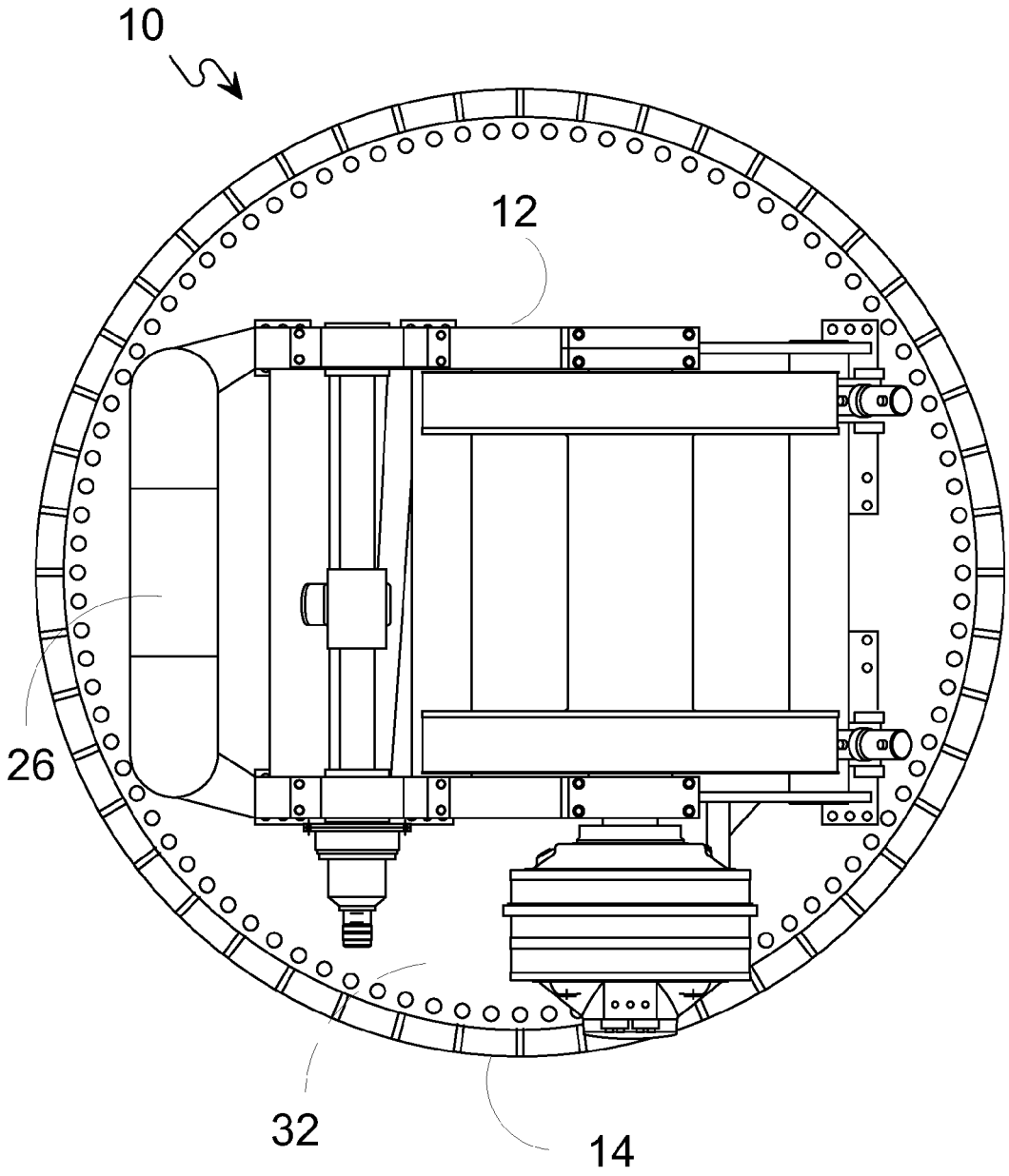
FIG. 10 is a top view of the winch of the present invention.

Referring to FIG. 10, shown is a top view of the winch of the present invention. The winch system 12 and staple 26 (tow point) of the present invention rotates on a large slewing ring 14 and reduces the side loading on the winch producing a tow line level wind.

Figure 11:
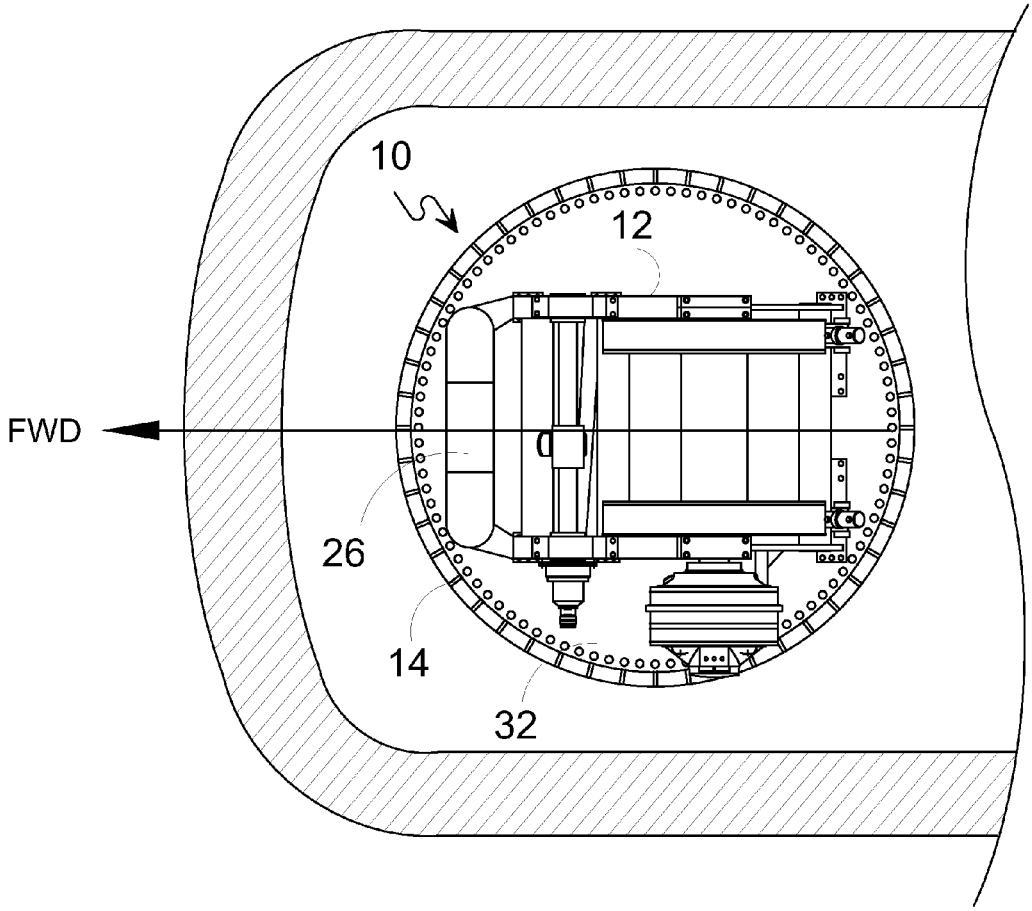
FIG. 11 is a top view of the winch of the present invention.
Figure 12:
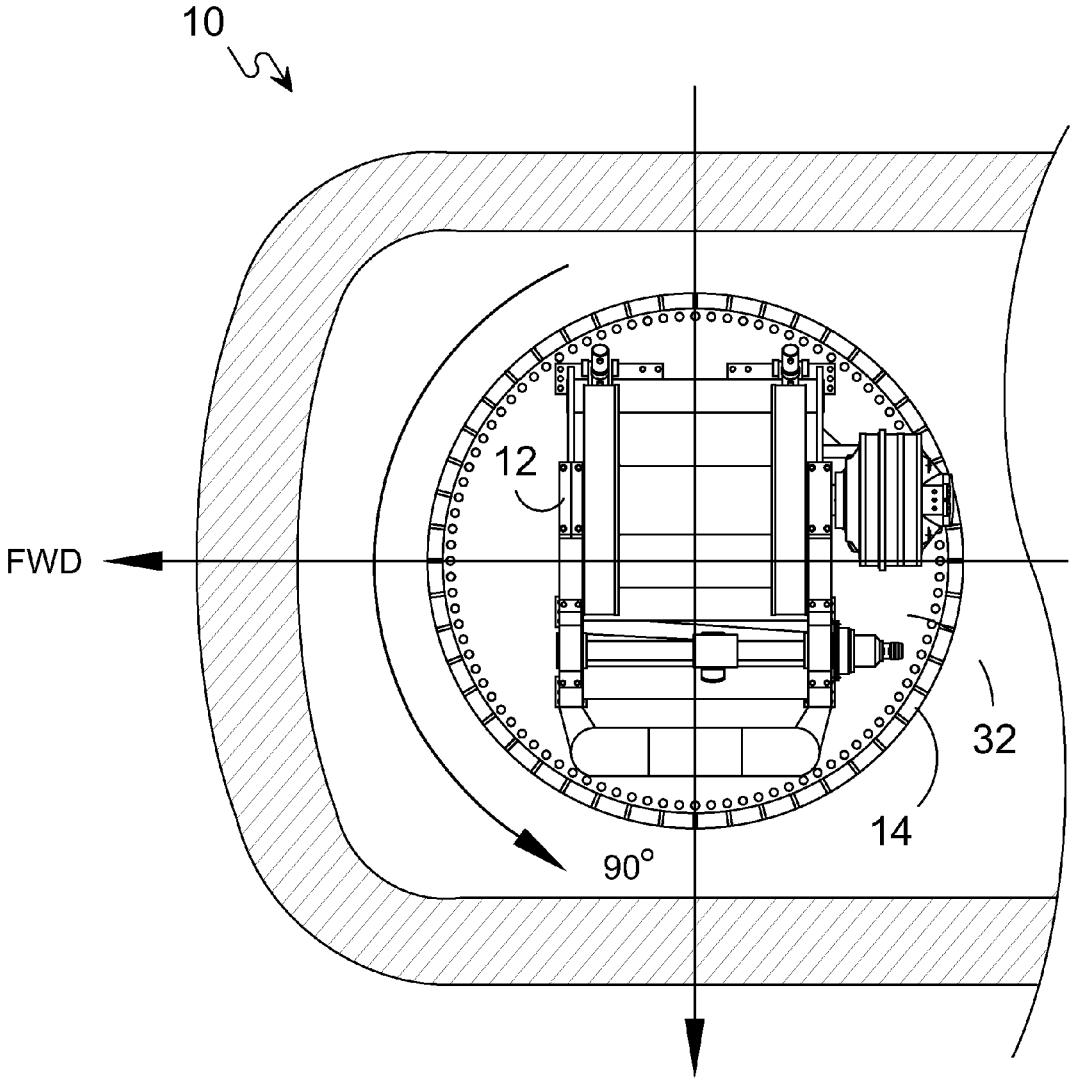
FIG. 12 is a top view of the winch of the present invention.

Referring to FIGS. 11 and 12, shown are top plan views of the winch system of the present invention 10. FIG. 11 illustrates the winch 12 and staple 26 in a forward position having inner race 32 and slewing ring 14 providing automatic rotation dependant on the line of force. The force responsive tow line apparatus 10 is mounted to travel at a right angle to the escort vessel deck thereby as the line of force between the escort vessel and distressed vessel angularly deviates from the center line of winch 12 and staple 26, winch system 10 automatically rotates until the line of force linearly aligns with the center line of winch system 10, as illustrated in FIG. 12.

Figure 13:
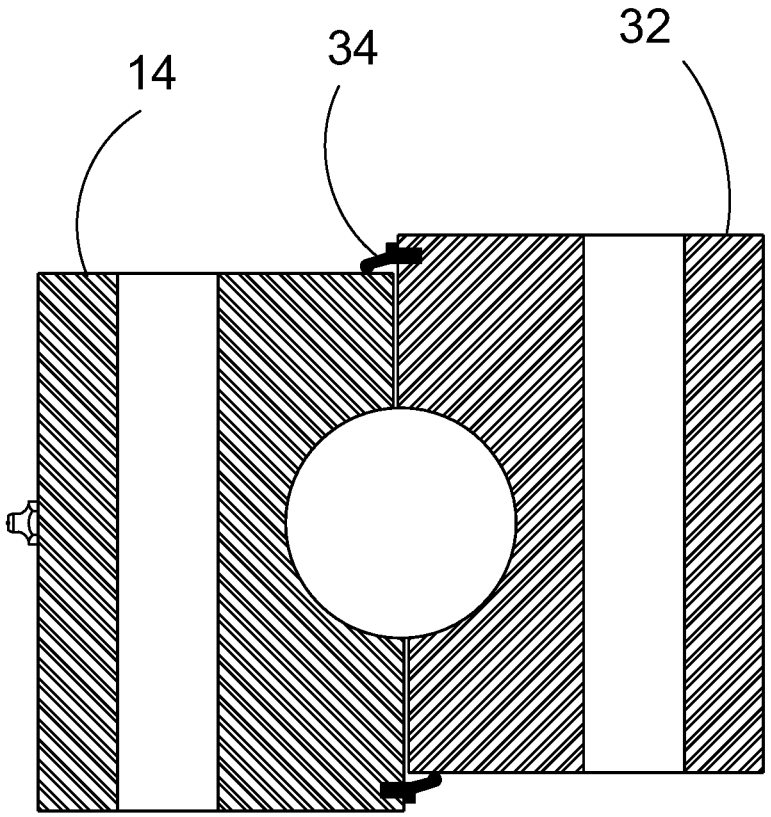
FIG. 13 is a view of the winch anti-trip bearing of the present invention.

Referring to FIG. 13, shown is a view of the winch anti-trip bearing of the present invention. Illustrated is inner race 32 and outer race 14 having anti-trip bearing 34 positioned thereon.

It will be understood that each of the elements described above, or two or more together may also find a useful application in other types of devices differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A winch for aligning a towline between a vessel and an escort vessel comprising:

a) an escort vessel having a winch mounted on a slewing ring;

b) a line secured between said escort vessel winch and a vessel; and c) an integral staple fastened to the slewing ring whereby line torque impinged upon the staple's divergent legs rotates said winch until said towline linearly extends between said winch and said vessel, said staple having a pair of apex divergent legs curvilinearly conjoined at the apex whereby towline torque causes the winch to rotate and the staple's apex curvilinear shape allows the towline to engage the staple's apex thereby reducing the heeling of said escort vessel.

2. The winch as recited in claim 1, wherein said staple has a pair of apex divergent legs curvilinearly conjoined at the apex whereby staple lateral torque causes the winch to rotate and the staple's apex curvilinear shape allows the towline to engage the staple's apex thereby reducing the heeling of said escort vessel.

3. The winch as recited in claim 2, wherein the heeling angle of the escort vessel can be decreased for the same towline pull force by rotating the escort vessel's winch toward the escort vessel center of pressure.

4. The winch as recited in claim 3, wherein the towline pull force can be increased by rotating the powered escort vessel winch toward the escort vessel center of pressure thereby increasing the heeling angle of the escort vessel.

5. The winch as recited in claim 4, further comprising an anti-slip bearing positioned between the inner race and the slewing ring.

6. The winch as recited in claim 5, wherein an automatically rotative winch will reduce the potential for capsizing an escort vessel by moving the staple closer to the escort vessel center of pressure thereby providing a safety mechanism for said escort vessel.

* * * * *